US006052553A

United States Patent [19]

Acquaviva et al.

[11] Patent Number: 6,052,553

[45] Date of Patent: Apr. 18, 2000

[54] POST-FUSING SHEET CONDITIONING APPARATUS

[75] Inventors: Thomas Acquaviva, Penfield; William Brant, Rochester, both of N.Y.

[73] Assignee: Xerox Corporation, Stamford, Conn.

[21] Appl. No.: 09/320,910

[22] Filed: May 27, 1999

[51] Int. Cl.[7] ..... G03G 15/20; G03G 15/00

[52] U.S. Cl. ..... 399/406; 399/341; 430/97

[58] Field of Search ..... 399/320, 341, 399/406, 407, 126; 118/58, 60, 244, 246, 680, 681; 430/97; 219/216; 101/147; 162/270, 271, 197

[56] References Cited

U.S. PATENT DOCUMENTS

| | | | |
|---|---|---|---|
| 5,264,899 | 11/1993 | Mandel | 399/341 |
| 5,434,029 | 7/1995 | Moser | 430/97 |
| 5,832,359 | 11/1998 | Acquaviva | 399/406 |
| 5,842,105 | 11/1998 | Acquaviva | 399/406 |
| 5,895,154 | 4/1999 | Acquaviva et al. | 399/341 |
| 5,920,751 | 7/1999 | Chow et al. | 399/406 X |

*Primary Examiner*—Sophia S. Chen
*Attorney, Agent, or Firm*—Tallam I. Nguti

[57] ABSTRACT

A post-fusing apparatus is provided in an electrostatographic reproduction machine for adding a controlled amount of moisture to a side of a fused toner image carrying copy sheet to control curl. The sheet conditioning apparatus includes a moisturizing agent supply and splitting assembly, including a supply source containing moisturizing agent and a plurality of rotatable metering rollers forming at least first and second moisture splitting nips, for splitting a layer of supplied moisturizing agent, and forming a thin film of moisture. The sheet conditioning apparatus also includes a rotatable moisture applying roller forming a moisture splitting and receiving nip with the moisture agent supply and splitting assembly, for receiving the thin film of moisture therefrom. The rotatable moisture applying roller also forms a moisture applying nip with a side of the fused toner image carrying copy sheet for applying a desired amount of moisture from the received thin film of moisture thereon onto the fused toner image carrying copy sheet so as to control curl therein.

Importantly, the sheet conditioning apparatus includes a control system, including nip pressure adjustment assemblies and a programmable controller, for adjusting nip pressure in the moisture receiving nip and the moisture applying nip to control the desired amount of moisture being applied onto the fused toner image copy sheet. The programmable controller also includes an equilibrium moisture content value ($M_f$) for copy sheets that are same as the fused toner image carrying copy sheet, and the nip pressure adjustment assemblies are adjusted and controlled such that the desired amount of moisture being applied is about 1.5% greater than the equilibrium moisture content value ($M_f$).

13 Claims, 2 Drawing Sheets

POST-FUSING SHEET CONDITIONING APPARATUS

BACKGROUND OF THE INVENTION

This invention relates generally to electrophotographic printing machines, and more particularly concerns an apparatus for automatically conditioning fused toner image carrying copy sheets to prevent sheet curl.

In a typical multicolor electrophotography, it is desirable to use an architecture which comprises a plurality of image forming stations. One example of the plural image forming station Architecture utilizes an image-on-image (IOI) system in which the photoreceptive member is recharged, re-imaged and developed for each color separation. This charging, imaging, developing and recharging, re-imaging and developing, all followed by transfer to paper, is done in a single to revolution of the photoreceptor in so-called single pass machines, while multi-pass architectures form each color separation with a single charge, image and develop, with separate transfer operations for each color. The single pass architecture offers a potential for high throughput.

In order to fix or fuse electroscopic toner material onto a support member by heat and pressure, it is necessary to apply pressure and elevate the temperature of the toner to a point at which the constituents of the toner material become tacky and coalesce. This action causes the toner to flow to some extent into the fibers or pores of the support medium (typically paper). Thereafter, as the toner material cools, solidification of the toner material occurs, causing the toner material to be bonded firmly to the support member. In both the xerographic as well as the electrostatographic recording arts, the use of thermal energy and pressure for fixing toner images onto a support member is old and well known.

One approach to heat and pressure fixing of electroscopic toner images onto a support has been to pass the support bearing the toner images between a pair of opposed roller members, at least one of which is internally heated. During operation of a fixing system of this type, the support member to which the toner images are electrostatically adhered is moved through the nip formed between the rolls and thereby heated under pressure. A large quantity of heat is applied to the toner and the copy sheet bearing the toner image. This heat evaporates much of the moisture contained in the sheet. The quantity of heat applied to the front and back sides of the sheet are often not equal. This causes different moisture evaporation from the two sides of the sheet and contributes to sheet curling.

Paper curl is defined as any deviation from it's flat state. In the xerographic process, fusing drives moisture out. When regaining moisture, paper experiences curl due to differential hygro-expansitivity and thermo-expansivity between the paper and toner, and dimensional instability of paper due to its moisture history. The paper expands due to moisture re-absorption, but the toner does not expand, thus developing curl. Paper curl is one of the primary causes for paper handling problems in copying machines. Problems, such as, stubbing, image deletions and improper stacking result from copy sheet curl. These problems are more severe for color copies than black and white due to differences in their toner mass area, substrates, and fuser characteristics.

The following disclosures may be relevant to various aspects of the present invention. U.S. Pat. No. 5,264,899 describes a system for adding moisture to a copy sheet. The toner fixation step of electrostatographic reproduction desiccates paper, which may lead to the formation of a wave along the sheet edge. The invention uses a pair of porous rolls defining a nip to transfer additional moisture to the copy sheet as it is passed through the nip. The added moisture prevents edge wave formation.

U.S. Pat. No. 5,434,029 describes an apparatus and method of preventing the curling of a substrate having toner images electrostatically adhered thereto which substrate has been subjected to heat for the purpose of fixing the toner images to the substrate. Simultaneous constraint of the copy substrate and the application of moisture thereto is effected by passing the substrate through the nip formed by two pressure engaged rollers, one of which is utilized for applying the water to the back side of the substrate as the substrate passes through the aforementioned nip.

There remains a need for a system for preventing curl caused by the loss of moisture from a copy sheet during the fixing step of electrostatographic reproduction or printing that is practical for use with electrostatographic machines and is non-subjective in indicating when the correct water thickness is obtained on metering rolls. Ordinarily, the film thickness on a transfer roll is set-up by adjusting the interference between a rubber metering roll and the transfer roll and observing the sheen on the metering roll. When the correct water thickness is obtained, the surface appearance on the black rubber metering roll changes from a gloss to a matte-like finish. Currently, the only way to make this adjustment is by eye, i.e., observe the appearance of the metering roller. This procedure is not acceptable for customer machine set-up or in manufacturing.

SUMMARY OF THE INVENTION

In accordance with one aspect of the present invention, there is provided a post-fusing apparatus is provided in an electrostatographic reproduction machine for adding a controlled amount of moisture to a side of a fused toner image carrying copy sheet to control curl. The sheet conditioning apparatus includes a moisturizing agent supply and splitting assembly, including a supply source containing moisturizing agent and a plurality of rotatable metering rollers forming at least first and second moisture splitting nips, for splitting a layer of supplied moisturizing agent, and forming a thin film of moisture. The sheet conditioning apparatus also includes a rotatable moisture applying roller forming a moisture splitting and receiving nip with the moisture agent supply and splitting assembly, for receiving the thin film of moisture therefrom. The rotatable moisture applying roller also forms a moisture applying nip with a side of the fused toner image carrying copy sheet for applying a desired amount of moisture from the received thin film of moisture thereon onto the fused toner image carrying copy sheet so as to control curl therein. Importantly, the sheet conditioning apparatus includes a control system, including nip pressure adjustment assemblies and a programmable controller, for adjusting nip pressure in the moisture receiving nip and the moisture applying nip to control the desired amount of moisture being applied onto the fused toner image copy sheet. The programmable controller also includes an equilibrium moisture content value ($M_f$) for copy sheets that are same as the fused toner image carrying copy sheet, and the nip pressure adjustment assemblies are adjusted and controlled such that the desired amount of moisture being applied is about 1.5% greater than the equilibrium moisture content value ($M_f$).

BRIEF DESCRIPTION OF THE DRAWINGS

Other features of the present invention will become apparent as the following description proceeds and upon reference to the drawings, in which.

DETAILED DESCRIPTION OF THE INVENTION

This invention relates to an imaging system which is used to produce color output in a single revolution or pass of a photoreceptor belt. It will be understood, however, that it is not intended to limit the invention to the embodiment disclosed. On the contrary, it is intended to cover all alternatives, modifications and equivalents as may be included within the spirit and scope of the invention as defined by the appended claims, including a multiple pass color process system, a single or multiple pass highlight color system and a black and white printing system.

Figure 1:
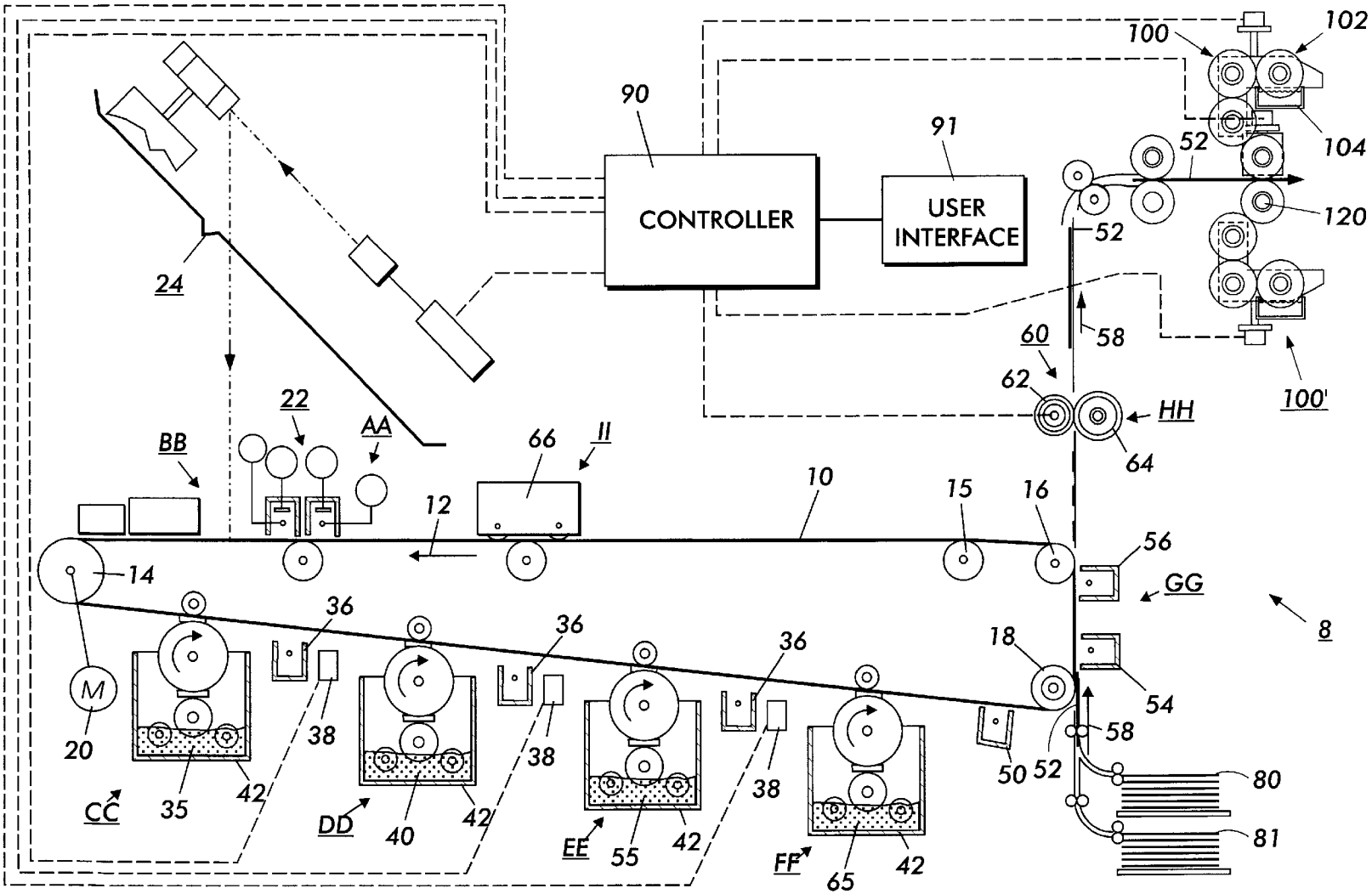
FIG. 1 is a schematic elevational view of a full color image-on-image single pass electrophotographic printing machine utilizing the apparatus and method described herein.

Turning now to FIG. 1, the electrostatographic reproduction or printing machine 8 of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14, a support roller 15, tension roller 16 and fixed roller 18 and the roller 14 is operatively connected to a drive motor 20 for effecting movement of the belt through the xerographic stations.

With continued reference to FIG. 1, a portion of belt 10 passes through charging station AA where a corona generating device, indicated generally by the reference numeral 22, charges the photoconductive surface of belt 10 to a relatively high, substantially uniform, preferably negative potential.

Next, the charged portion of photoconductive surface is advanced through an imaging/exposure station BB. At imaging/exposure station BB, a controller, indicated generally by reference numeral 90, receives the image signals representing the desired output image and processes these signals to convert them to the various color separations of the image which is transmitted to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_0$, undergoes dark decay to a level $V_{ddp}$ equal to about −500 volts. When exposed at the exposure station BB it is discharged to $V_{expose}$ equal to about −50 volts. Thus after exposure, the photoreceptor contains a monopolar voltage profile of high and low voltages, the former corresponding to charged areas and the latter corresponding to discharged or background areas.

At a first development station CC with black toner 35, developer structure, indicated generally by the reference numeral 42 utilizing a hybrid jumping development (HJD) system, the development roll, better known as the donor roll, is powered by two development fields (potentials across an air gap). The first field is the ac jumping field which is used for toner cloud generation. The second field is the dc development field which is used to control the amount of developed toner mass on the photoreceptor. The toner cloud causes charged toner particles to be attracted to the electrostatic latent image. Appropriate developer biasing is accomplished via a power supply. This type of system is a non-contact type in which only toner particles (black, for example) are attracted to the latent image and there is no mechanical contact between the photoreceptor and a toner delivery device to disturb a previously developed, but unfixed, image.

A corona recharge device 36 having a high output current vs. control surface voltage (I/V) characteristic slope is employed for raising the voltage level of both the toned and untoned areas on the photoreceptor to a substantially uniform level. The recharging device 36 serves to recharge the photoreceptor to a predetermined level.

A second exposure/imaging device 38 which comprises a laser based output structure is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station DD and is presented to the latent images on the photoreceptor by way of a second HSD developer system. A power supply (not shown) serves to electrically bias the developer structure to a level effective to develop the discharged image areas with negatively charged yellow toner particles 40.

The above procedure is repeated for a third imager at a third development station EE containing a third suitable color toner 55 such as magenta, and at a fourth development station FF containing a fourth suitable color toner 65 such as cyan. The exposure control scheme described below may be utilized for these subsequent imaging steps. In this manner a full color composite toner image is developed on the photoreceptor belt.

To the extent to which some toner charge is totally neutralized, or the polarity reversed, thereby causing the composite image developed on the photoreceptor to consist of both positive and negative toner, a negative pre-transfer dicorotron member 50 is provided to condition the toner for effective transfer to a substrate using positive corona discharge.

Subsequent to image development a sheet of support material 52 is moved either tray 80 or 81 into contact with the toner images at transfer station GG. The sheet of support material is advanced to transfer station GG by conventional sheet feeding apparatus, not shown. Preferably, the sheet feeding apparatus includes a feed roll contacting the uppermost sheet of a stack copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station GG.

Transfer station GG includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station HH. Fusing station HH includes a fuser assembly or fusing apparatus, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52. After fusing, a chute, not shown, guides the advancing sheets 52 towards a catch tray, (not shown), for subsequent removal from the machine 8 by the operator.

After the sheet of support material is separated from the photoconductive surface of belt 10, the residual toner particles carried by the non-image areas on the photoconductive surface are subsequently removed at cleaning station 11 using, for example, a cleaning brush structure contained in a housing 66.

It is believed that the foregoing description is sufficient for the purposes of the present application to illustrate the general operation of an electrostatographic color reproduction or printing machine 8. The post-fusing sheet conditioning apparatus is generally referred to as reference numeral 100.

As shown, the electrostatographic reproduction machine 8 includes a first and a second post-fusing sheet conditioning apparatus shown as 100 and 100' that are mounted oppositely to each other, and downstream of the fuser or fusing apparatus 60, relative to movement of the copy sheet 52, for adding the controlled amount of moisture to each side of the copy sheet 52 so as to control curl in accordance with the present invention. As shown, the top post-fusing sheet conditioning apparatus 100 (except for the second stepper motor 146 in the top apparatus 100) is identical to the bottom and reversed mounted post-fusing sheet conditioning apparatus 100'. Accordingly, only the top apparatus 100 will be described in detail, with the understanding such description is equally applicable to the elements and their functions in the bottom apparatus 100'.

Figure 2:
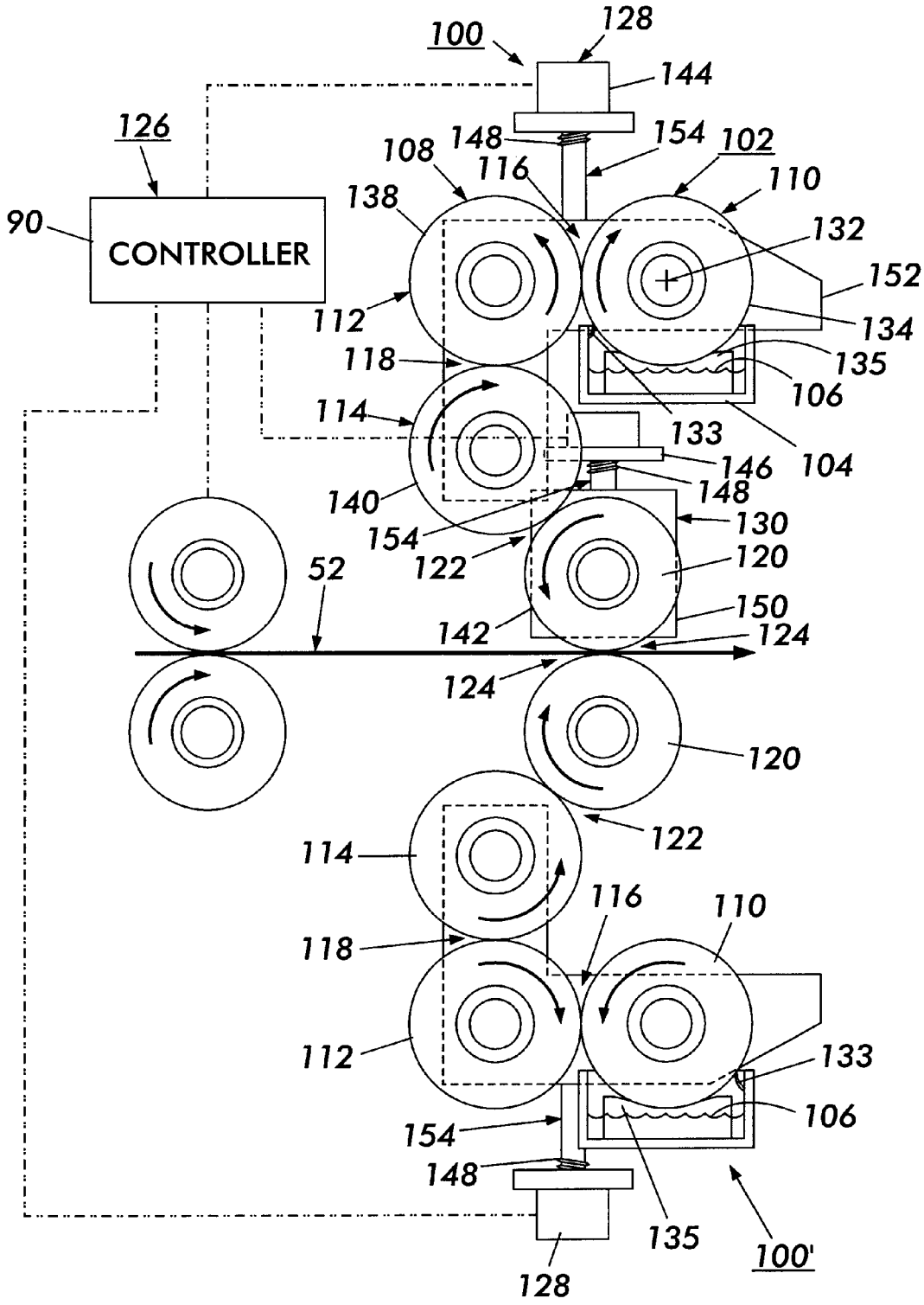
FIG. 2 is a detailed elevational side view of the post-fusing sheet conditioning apparatus and method in accordance with the present invention.

Referring now to FIGS. 1 and 2, the post-fusing sheet conditioning apparatus 100 can be seen as including a moisturizing agent supply and splitting assembly 102, including a supply source 104 containing moisturizing agent 106 and a metering rollers assembly 108 plurality of rotatable metering rollers 110, 112, 114, forming at least first and second moisture splitting nips 116, 118, for splitting a layer of supplied moisturizing agent, and forming a thin film of moisture. The sheet conditioning apparatus 100 also contains a rotatable moisture applying roller 120 forming a moisture receiving nip 122 with the moisture agent supply and splitting assembly 102, for receiving the thin film of moisture therefrom. The rotatable moisture applying roller 120 also forms a moisture applying nip 124 with one side of the fused toner image carrying copy sheet 52 for applying a desired amount of moisture from the received thin film of moisture thereon onto the one side of the fused toner image carrying copy sheet, so as to control curl therein.

Importantly, the sheet conditioning apparatus 100 includes a control system 126, including nip pressure adjustment assemblies, 128, 130 and a programmable controller 90, for adjusting nip pressure in the moisture receiving nip 122 and/or in the moisture applying nip 124 to control the desired amount of moisture being applied onto the fused toner image carrying copy sheet 52. The programmable controller 90 includes an equilibrium moisture content ($M_f$) value for copy sheets that are same as the fused toner image carrying copy sheet, and each nip pressure adjustment assembly 128, 130 is adjusted and controlled such that the desired amount of moisture being applied onto the one side of the copy sheet is about 1.5% of the $M_f$ value.

Specifically, as shown in FIG. 2, the sheet conditioning apparatus 100 includes the supply source 104 for containing a quantity of moisturizing agent 106, and a first rotatable metering roller 110 having a pivotable axis 132, and a first moisture bearing surface 134. A coating means such as a wick 135 is provided for applying a layer of moisture, from the moisturizing agent 106 contained in the supply source, onto the first moisture bearing surface of the first metering roller 110. The sheet conditioning apparatus 100 also includes a second rotatable metering roller 112 having a second moisture bearing surface 138 forming a first moisture layer splitting nip 116 with the first moisture bearing surface 134 for splitting the layer of moisture on the first metering roller, and forming a relatively thin layer of moisture on the second metering roller 112. A third rotatable metering roller 114 having a third moisture bearing surface 140 forming a thin moisture layer second splitting nip 118 with the second moisture bearing surface 138 of the second metering roller for splitting the relatively thin layer of moisture on the second metering roll, and forming a film of moisture on the third metering roller 114.

The sheet conditioning apparatus 100 further includes a moisture applying roller 120 having a fourth moisture bearing surface 142. The fourth surface 142 forms a moisture film splitting and receiving nip 122 with the third moisture bearing surface 140 of the third metering roller 114 for splitting the film of moisture on the third metering roll, and forming a desired thin film of moisture on the moisture applying roller 120. The fourth surface 142 also forms a moisture applying nip 124 with one side of the fused toner image carrying copy sheet 52 for applying a desired amount of moisture from the thin film moisture thereon onto the fused toner image carrying copy sheet, so as to control curl therein.

Importantly, the sheet conditioning apparatus 100 includes the control system 126, including nip pressure adjustment assemblies 128, 130, and the programmable controller 90, for adjusting nip pressure in the moisture receiving nip 122 and the moisture applying nip 124 to control the desired amount of moisture being applied onto the one side of the fused toner image copy sheet. As pointed out above, the programmable controller 90 includes an equilibrium moisture content value ($M_f$) for copy sheets that are same as the fused toner image carrying copy sheet, and each nip pressure adjustment assembly 128, 130, is adjusted and controlled such that the desired amount of moisture being applied is about 1.5% greater than the $M_f$ value.

Preferably, in the post-fusing sheet conditioning apparatus 100 the moisturizing agent 106 contained in the supply source 104 is water, and the plurality of rotatable metering rolls includes three rotatable metering rolls 110, 112, 114. Each metering roller 110, 112, 114 of the plurality of metering rollers preferably has a urethane rubber surface coating that forms the moisture bearing surface thereto. As shown, the apparatus 100 includes a first stepper motor 144 for moving the moisturizing agent supply and splitting assembly 102 towards and away from the moisture applying roller 120, and a second stepper motor 146 for moving the moisture applying roller 120 towards and away from the fused toner image carrying copy sheet 52 or its path.

In accordance with the present invention, the programmable controller 90 is programmed to contain and use the equilibrium moisture content value ($M_f$), and additional stored information including: (i) coefficient of expansion of the copy sheet carrying the fused toner image ($A_p$); (ii) coefficient of expansion of toner of the type forming the fused toner image on the copy sheet ($A_t$); (iii) room ambient temperature ($T_f$); (iv) temperature of the fused toner image carrying copy sheet just before moisture application ($T_i$); and (v) coefficient of expansion of moisture in the copy sheet ($B_p$), and controls said desired amount of moisture being applied as a function of said additional stored information. Preferably, each actual nip pressure adjustment ($P_a$), that is made in the moisture applying nip 124 for controlling the desired amount of moisture being applied, is proportional to $M_f+[(A_p-A_t)\times(T_f-T_i)]/B_p$.

Referring still to FIGS. 1 and 2, it preferred that the sheet conditioning apparatus 100 apply a uniform amount of water to both sides of the copy sheet 52 after fusing, thus enabling the sheet 52 to leave the machine 8 in a moisture equilibrated condition, and thus to have low or no curl. The metering rollers 110, 112, 114 preferably have textured surfaces 134, 138, 140, and are moistened through capillary action and film splitting within the nips 116, 118. The desired amount of moisture or water transferred from the moisture applying roller 120 onto the copy sheet 52 is varied and controlled by either adjusting the normal force between metering rollers assembly 102 and the moisturizing or moisture applying roller 120, or that between the moisture applying roller 120 and copy sheet 52.

One of the principle causes of paper curl is the shrinkage due to loss of moisture when paper passes through a hot fuser nip. Immediately upon leaving the fusing nip of the fusing apparatus, the toner image is still molten. Shortly thereafter, the toner passes through Tg (glass transition temperature) and then hardens. When it hardens it takes on the size of the paper which is now close to its smallest dimension. Within the next 2 to 120 minutes, depending on the particular type of copy sheet paper, the sheet of paper equilibrates and expands by picking up moisture from the air. Since the toner layer does not expand with moisture, the composite sheet behaves as a bi-material strip with one side becoming longer than the other. It generally curls toward the image side.

Thus it is preferred that moisture be added to the fused sheet of paper immediately after it leaves the fusing apparatus so that the lost moisture is restored and it is at its equilibrated size before the toner hardens as above. Without moisturization, fused copy sheets of paper have been found to have about 250 mm hanging curl. That is, when such a sheet is held in the middle of the short edge and suspended vertically, the radius of curvature of the curled sheet was found to be about 250 mm.

Referring in particular to FIG. 2, the first metering roller 110 is positioned above a trough or supply source 104 containing water or some other conditioning agent 106. As discussed above, it each of the metering rollers 110, 112, 114, includes a urethane rubber coating having a specified thickness and surface finish, such as a textured finish for effectively bearing or carrying moisture from the wick 135. The blade arrangement 133 may be provided for removing excess water or moisture from the first roller surface 134. As shown, first metering roller 110 rotates in a clockwise direction and makes interference nip contact with second metering roller 112 which rotates in the counterclockwise direction. In this arrangement, the finish, materials, and nip pressures determine the amount of water or moisture transferred between any two rollers.

Accordingly, a water or moisture layer created on the surface of the first metering roller 110, is split in the first splitting nip 116 with the residual water or moisture going onto the second metering roller 112. Similarly, the third metering roller 114 makes an interference nip contact with the second metering roller 112. Moisture film splitting occurs again within the second moisture splitting nip 118 between the second metering roller 112 and the third metering roller 114. Finally, the film of water or moisture on the third metering roller 114 is further split once more when the third metering roller 114 contacts the moisture applying roller 120 when the moisture receiving nip 122. As shown, a similar set of rollers are positioned above and below the paper path to moisturize both sides of the passing sheet.

Experiments confirm that the nip pressure created between the moisture applying rollers and the paper should be high in order to ensure sufficient penetration of the water film into the paper fibers. In the dual conditioning apparatus arrangement of the present invention, a lower moisture applying roller 120 is fixed in position. In the second nip pressure adjustment assembly 130, a second adjustment screw 148 applies force on a first bearing block 150 holding the upper moisture applying roller 120 in place. By rotating the screw 148 manually or automatically with the second stepper motor 146, the upper moisture applying roller 120 can be caused to press harder on the lower moisture applying roller 120 '.

Preferably, the first, second and third metering rollers 110, 112, 114 are locked together through gear sets (not shown). As such, the three metering rollers assembly 102 can be pivoted about the axis 132 of the first metering roller 110.

A cross arm 152 is attached to the first and second metering rollers 110, 112, and such arm is then attached to a vertical member 154 which is then attached to the adjusting screw 148. When turned, the adjusting screw 148 raises or lowers the vertical member 154 thus increasing or decreasing the nip pressure applied between the third metering roller 114 and the moisture applying roller 120, for example. In this manner, the amount of water applied to individual sheets can be controlled. The nip pressure between the moisture applying roller 120 and the copy sheet 52 can be fixed or variable as is the pressure between the third metering roller 114 and moisture applying roller 120. The moisture applying roller 120 can also be momentarily separated from the copy sheet 52 or its path, in order to prevent excess moisture being deposited thereon during an inter-copy gap or period.

Importantly in accordance with the present invention, an algorithm is provided for making nip pressure adjustments. For example, information would be needed on substrate type, room ambient temperature, equilibrated moisture content of the type of paper carrying the fused toner image and being conditioned, thermal expansion coefficient of the paper being conditioned, temperature of paper as it enters the conditioning apparatus, and moisture expansion coefficient of the paper being conditioned. In order to achieve a flat sheet after fusing with no curl, it was found that a preferred amount of moisture or water to be added should be about 1.5% higher than the equilibrium moisture contact. Therefore, the algorithm for controlling the motor 146 which rotates the adjustment screw 148 is preferably as follows:

Rotation of adjusting screw, and hence a nip pressure adjustment ($P_a$) is proportional to $M_f+[(A_p-A_t)\times(T_f-T_i)]/B_p$, where:

$M_f$=final moisture contact at equilibrium (base don paper type and room RH);

$A_p$=paper coefficient of expansion;

$A_t$=toner coefficient of expansion;

$T_f$=room ambient temperature;

$T_i$=temperature of paper as it enters conditioner (a function of fuser temperature);

$B_p$=paper moisture coefficient of expansion; and $M_f$, $A_p$, and $B_p$ are a function of the type of paper being run. The toner coefficient of expansion $A_t$ is constant for the type of machine.

Other hardware not shown in the figure are devices to keep the water level in the trough at a constant level as water is consumed by the passing paper, and devices for opening and closing the moisture applying nip 124 for jam clearance.

Sheets are conditioned post-fusing as such by applying a thin film of water in a controlled manner to both sides of a sheet. This is done in order to prevent the sheet from curling as it equilibrates to room temperature and humidity after fusing. The thin film of moisture or water is thus applied immediately after fusing, and in a high pressure roller nip 122 which receives its water through a series of metering rollers, 110, 112, 114, and a moisture applying roller 120, and from a water supply source consisting of a trough 104 and devices for removing excess water. The amount of moisture or water applied to each sheet is adjusted by controlling the amount of pressure applied between the metering rollers and the moisture applying rollers, or between the moisture applying rollers and the paper, or between both the metering and moisture applying rollers.

As can be seen, there has been provided, in accordance with the present invention a post-fusing apparatus is provided in an electrostatographic reproduction machine for adding a controlled amount of moisture to a side of a fused toner image carrying copy sheet to control curl. The sheet conditioning apparatus includes a moisturizing agent supply and splitting assembly, including a supply source containing moisturizing agent and a plurality of rotatable metering rollers forming at least first and second moisture splitting nips, for splitting a layer of supplied moisturizing agent, and forming a thin film of moisture. The sheet conditioning apparatus also includes a rotatable moisture applying roller forming a moisture splitting and receiving nip with the moisture agent supply and splitting assembly, for receiving the thin film of moisture therefrom. The rotatable moisture applying roller also forms a moisture applying nip with a side of the fused toner image carrying copy sheet for applying a desired amount of moisture from the received thin film of moisture thereon onto the fused toner image carrying copy sheet so as to control curl therein. Importantly, the sheet conditioning apparatus includes a control system, including nip pressure adjustment assemblies and a programmable controller, for adjusting nip pressure in the moisture receiving nip and the moisture applying nip to control the desired amount of moisture being applied onto the fused toner image copy sheet. The programmable controller also includes an equilibrium moisture content value ($M_f$) for copy sheets that are same as the fused toner image carrying copy sheet, and the nip pressure adjustment assemblies are adjusted and controlled such that the desired amount of moisture being applied is about 1.5% greater than the equilibrium moisture content value ($M_f$).

While this invention has been described in conjunction with a particular embodiment thereof, it shall be evident that many alternatives, modifications and variations will be apparent to those skilled in the art. Accordingly, the present invention is intended to embrace all such alternatives, modifications and variations as fall within the spirit and broad scope of the appended claims.

We claim:

1. A post-fusing sheet conditioning apparatus in an electrostatographic reproduction machine for adding a controlled amount of moisture to a side of a fused toner image carrying copy sheet to control curl, the sheet conditioning apparatus comprising:

(a) a moisturizing agent supply and splitting assembly including a supply source containing moisturizing agent, and a plurality of rotatable metering rollers forming at least first and second moisture splitting nips for splitting a layer of supplied moisturizing agent, and forming a thin film of moisture;

(b) a rotatable moisture applying roller forming a moisture receiving nip with said moisturizing agent supply and splitting assembly for receiving said thin film of moisture therefrom, and said rotatable moisture applying roller forming a moisture applying nip with a side of the fused toner image carrying copy sheet for applying a desired amount of moisture from said received thin film of moisture thereon onto the fused toner image carrying copy sheet so as to control curl therein;

(c) control means, including nip pressure adjustment assemblies and a programmable controller, for adjusting nip pressure in said moisture receiving nip and said moisture applying nip to control said desired amount of moisture being applied onto the fused toner image carrying copy sheet, said programmable controller storing an equilibrium moisture content value ($M_f$) for copy sheets that are same as the fused toner image carrying copy sheet, and said nip pressure adjustment assemblies being adjusted such that said desired amount of moisture being applied is about 1.5% greater than said equilibrium moisture content value $M_f$; and (d) a stepper motor for moving said moisture applying roller towards and away from a path of the fused toner image carrying copy sheet.

2. The post-fusing sheet conditioning apparatus of claim 1, wherein said moisturizing agent contained in said supply source comprises water.

3. The post-fusing sheet conditioning apparatus of claim 1, wherein said plurality of rotatable metering rollers comprise three rotatable metering rollers.

4. The post-fusing sheet conditioning apparatus of claim 1, wherein each metering roller of said plurality of metering rollers includes a urethane rubber surface coating.

5. The post-fusing sheet conditioning apparatus of claim 1, including a stepper motor for moving said moisturizing agent supply and splitting assembly towards and away from said moisture applying roller.

6. The post-fusing sheet conditioning apparatus of claim 1, wherein said programmable controller contains additional stored information including: (i) a coefficient of expansion of the fused toner image carrying copy sheet ($A_p$); (ii) a coefficient of expansion of toner of a type forming the fused toner image on the fused toner image carrying copy sheet ($A_t$); (iii) room ambient temperature ($T_f$); (iv) temperature of the fused toner image carrying copy sheet just before moisture application ($T_i$); and (v) a coefficient of expansion of moisture in the fused toner image carrying copy sheet ($B_p$), and wherein said programmable controller controls said desired amount of moisture being applied as a function of said additional stored information.

7. The post-fusing sheet conditioning apparatus of claim 6, wherein a pressure adjustment ($P_a$), made in said moisture applying nip for controlling said desired amount of moisture being applied, is proportional to $M_f+[(A_p-A_t)\times(T_f-T_i)]/B_p$, where $M_f$ is the equilibrium moisture content value for the fused toner image carrying copy sheet.

8. A post-fusing sheet conditioning apparatus in an electrostatographic reproduction machine for adding a controlled amount of moisture to a side of a fused toner image carrying copy sheet to control curl, the sheet conditioning apparatus comprising:

(a) a supply source for containing a quantity of moisturizing agent;

(b) a first rotatable metering roller having a first moisture bearing surface;

(c) coating means for applying a layer of moisture, from said moisturizing agent contained in said supply source, onto said first moisture bearing surface of said first metering roller;

(d) a second rotatable metering roller having a second moisture bearing surface forming a first moisture splitting nip with said first moisture bearing surface for splitting said layer of moisture on said first metering roller and forming a relatively thin layer of moisture on said second metering roller;

(e) a third rotatable metering roller having a third moisture bearing surface forming a second moisture splitting nip with said second moisture bearing surface of said second metering roller for splitting said relatively thin layer of moisture on said second metering roller and forming a film of moisture on said third metering roller;

(f) a moisture applying roller having a fourth moisture bearing surface forming a moisture receiving nip with said third moisture bearing surface of said third metering roller for splitting said film of moisture on said third metering roller and forming a desired thin film of moisture on said moisture applying roller, and said fourth moisture bearing surface forming a moisture applying nip with a side of the fused toner image carrying copy sheet for applying a desired amount of moisture from said thin film of moisture thereon onto the fused toner image carrying copy sheet so as to control curl therein;

(g) control means, including a nip pressure adjustment assembly and a programmable controller, for adjusting nip pressure in said moisture applying nip to control said desired amount of moisture being applied onto the fused toner image carrying copy sheet, said programmable controller storing an equilibrium moisture content value $M_f$ for copy sheets that are same as the fused toner image carrying copy sheet, and said nip pressure adjustment assembly being adjusted such that said desired amount of moisture being applied is about 1.5% greater than said value $M_f$; and (d) a stepper motor for moving said moisture applying roller towards and away from a path of the fused toner image carrying copy sheet.

9. An electrostatographic reproduction machine comprising:

(a) electrostatographic means, including a movable image bearing member, for forming and transferring a toner image onto a copy sheet;

(b) a fusing apparatus including a heated fusing member for heating and fusing a toner image onto the copy sheet; and (c) a first and a second post-fusing sheet conditioning apparatus mounted oppositely to each other and downstream of said fusing apparatus relative to movement of the copy sheet for adding a controlled amount of moisture to each side of the copy sheet to control curl, each said post-fusing sheet conditioning apparatus including:

(i) a moisturizing agent supply and splitting assembly including a supply source containing moisturizing agent, and a plurality of rotatable metering rollers forming at least first and second moisture splitting nips for splitting a layer of supplied moisturizing agent, and forming a thin film of moisture;

(ii) a rotatable moisture applying roller forming a moisture splitting and receiving nip with said moisture agent supply and splitting assembly for receiving said thin film of moisture therefrom, and said rotatable moisture applying roller forming a moisture applying nip with a side of a fused toner image carrying copy sheet for applying a desired amount of moisture from said received thin film of moisture thereon onto the fused toner image carrying copy sheet so as to control curl therein, (iii) control means, including nip pressure adjustment assemblies and a programmable controller, for adjusting nip pressure in said moisture receiving nip and said moisture applying nip to control said desired amount of moisture being applied onto the fused toner image carrying copy sheet, said programmable controller storing an equilibrium moisture content value ($M_f$) for copy sheets that are same as the fused toner image carrying copy sheet, and said nip pressure adjustment assemblies being adjusted such that said desired amount of moisture being applied is about 1.5% greater than said equilibrium moisture content value ($M_f$); and (iv) a stepper motor for moving said moisture applying roller towards and away from a path of the fused toner image carrying copy sheet.

10. The electrostatographic reproduction machine of claim 9, wherein each metering roller of said plurality of metering rollers includes a urethane rubber surface coating.

11. The electrostatographic reproduction machine of claim 9, including a stepper motor for moving said moisturizing agent supply and splitting assembly of each said post-fusing sheet conditioning apparatus towards and away from said moisture applying roller.

12. The electrostatographic reproduction machine of claim 9, wherein said programmable controller contains additional stored information including: (i) a coefficient of expansion of the fused toner image carrying copy sheet ($A_p$); (ii) a coefficient of expansion of toner of a type forming a fused toner image on the fused toner image carrying copy sheet ($A_t$); (iii) room ambient temperature ($T_f$); (iv) temperature of the fused toner image carrying copy sheet just before moisture application ($T_i$); and (v) a coefficient of expansion of moisture in the fused toner image carrying copy sheet ($B_p$), and wherein said programmable controller controls said desired amount of moisture being applied as a function of said additional stored information.

13. The electrostatographic reproduction machine of claim 12, wherein a pressure adjustment ($P_a$), made in said moisture applying nip for controlling said desired amount of moisture being applied, is proportional to $M_f+[(A_p-A_t)\times(T_f-T_i)]/B_p$, where $M_f$ is an equilibrium moisture content value for the fused toner image carrying copy sheet.

* * * * *